United States Patent [19]

Wang-Lee

[11] Patent Number: 4,721,125

[45] Date of Patent: Jan. 26, 1988

[54] HEIGHT ADJUSTABLE CRUTCH

[76] Inventor: Mei-Chin Wang-Lee, No. 6, Jen-Shou Street, Hsin-Ying City, Tainan Hsien, Taiwan

[21] Appl. No.: 943,997

[22] Filed: Dec. 22, 1986

[51] Int. Cl.[4] ..... A61H 3/02

[52] U.S. Cl. ..... 135/69; 135/65; 135/68; 135/75; 403/100; 403/102; 403/325

[58] Field of Search ..... 135/68, 69, 70, 71, 135/72; 33/515, 161

[56] References Cited

U.S. PATENT DOCUMENTS 2,474,722 6/1949 Blume ..... 135/69

3,730,198 5/1973 Johnston et al. ..... 135/69

4,509,741 4/1985 Smith ..... 33/515

*Primary Examiner*—Robert A. Hafer

*Assistant Examiner*—Charles H. Sam

*Attorney, Agent, or Firm*—Shlesinger Arkwright & Garvey

[57] ABSTRACT

A height adjustable crutch comprised of a one piece member which can serve as the combination of the bow and the carrier without any bolt and pins used in conventional types for securing them, so the structure of the height adjustable crutch is simpler and stronger than the conventional types that we can find today.

11 Claims, 7 Drawing Figures

HEIGHT ADJUSTABLE CRUTCH

BACKGROUND OF THE INVENTION

The present invention relates to a height adjustable crutch, and more particularly to a type of height adjustable crutch in which the structure is simpler and stronger than the conventional types that one finds today.

As is well known, the general type of crutch has a dead structure, the height of which can not be adjusted in response to the requirements of different users, so the makers have to prepare a number of sizes.

Referring to FIG. 1, U.S. Pat. No. 4,509,741 provides an improved type of crutch having a bow A comprised of a pair of hollow tubular vertical members which are angled downwardly toward each other with their lower extremities aligned in a uniformly spaced parallel relationship. A hollow tubular carrier B is disposed between and in abutment with these tubular extremities and the three members are secured by bolt C through them in the upper area where they are in abutment and by an integral encircling element D at their lower extremities which is annexed to the lower extremities of the tubular members of the bow A by pins D1, D2. The tubular carrier B is orificed at selective intervals and receives an orificed telescoping foot member E provided with one outwardly radial spring F biased detent G, as shown in FIG. 2, which is an enlarged fragmentary sectional view of FIG. 1. This detent G serves to lock the foot member E in any disposition relative to the tubular carrier B when the detent G is passed through any registering orifices of the tubular carrier B and foot member E. The disposition of the foot member E relative to the tubular carrier B may be changed by passing the detent G radially inwardly to where the foot member E may then be moved upwardly or downwardly in relation to the tubular carrier B for redisposition and locking by the detent G.

However, as the strength of the structure between the tubular extremities of the bow A and the tubular carrier B of such a height adjustable crutch is dependent only on bolt C and pins D1, D2, it is not either durable or strong enough to be used for a long time without looseness or breakage. The minimum height of the crutch especially is limited by the position of the bolt C which is disposed radially through the tubular carrier B and blocks the top end of the same, so the adjustable range of the crutch is limited by the length of the tubular carrier B. As the crutch is adjusted in a relatively higher condition, the top end of the foot member E will be disposed near to the lower extremity of the tubular carrier B, so the stress generated by the foot member E will center on the pins D1, D2. For this reason, the encircling element D shall be loosened or broken sooner or later.

SUMMARY OF THE INVENTION

Therefore, an object of the present invention is to provide a height adjustable crutch of a structure both strong and durable.

A further object of the present invention is to provide a height adjustable crutch simple enough to be manufactured.

Accordingly, the present invention provides a height adjustable crutch which comprises a one piece member, serving as the combination of the bow and the tubular carrier of the above-mentioned height adjustable crutch, having a pair of hollow tubular vertical portions which are angled downwardly toward each other with their lower extremities aligned in a uniformly spaced parallel relationship in the hollow tubular condition and a hollow tubular carrier which is integrated with the lower extremities of the above-mentioned tubular portions and orificed at selective intervals, a foot member telescoped within the above-mentioned tubular carrier, which can be locked in any disposition relative to the same, an arm member which is annexed to the top ends of the tubular portions of the one piece member and a hand member which is annexed between the uniformly parallel portions of the same.

BRIEF DESCRIPTION OF THE DRAWINGS

The present invention is illustrated by way of example in the accompanying drawings, in which.

DETAILED DESCRIPTION OF THE INVENTION

Figure 1:
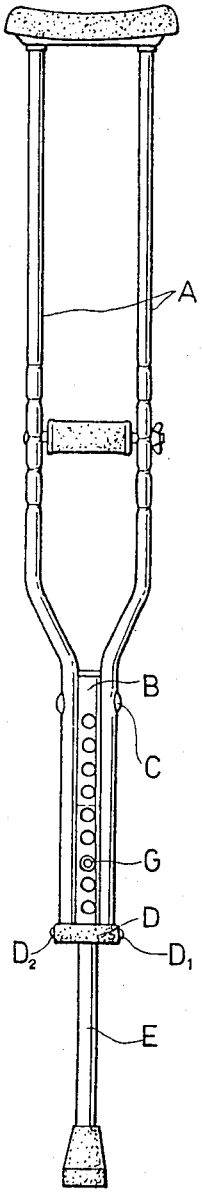
FIG. 1 (PRIOR ART)
FIGS. 1 and 2 show the prior art.
Figure 2:
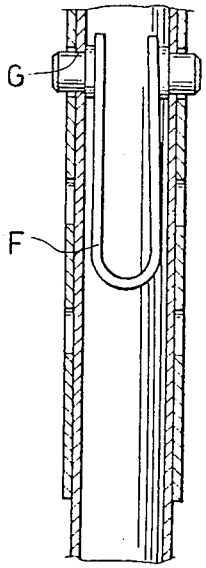
FIG. 2 (PRIOR ART)
Figure 3:
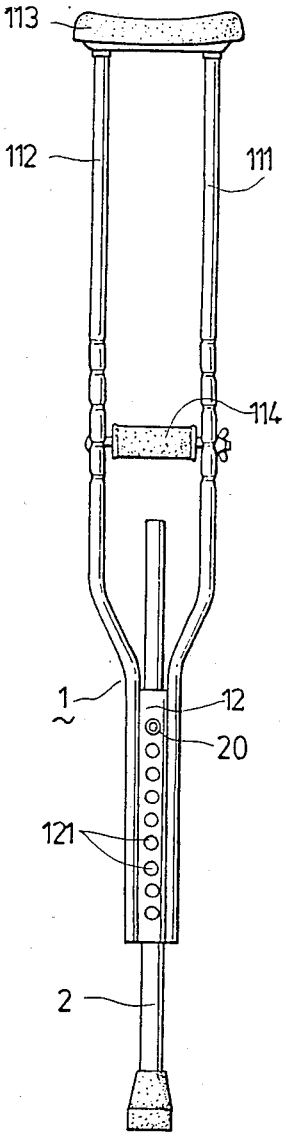
FIG. 3 is a perspective view of the height adjustable crutch according to the present invention; and FIG. 4 to FIG. 7 is a series of perspective views illustrated for the manufacturing process of the one piece member.
Figure 4:
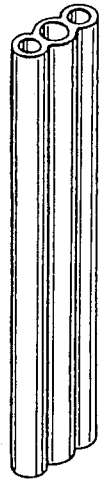
Figure 5:
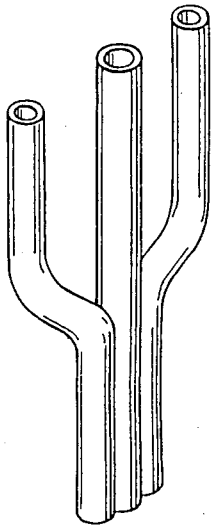

Referring to FIG. 3 which is a perspective view of an embodiment according to the present invention, the height adjustable crutch comprises a one piece member 1. The one piece member 1 comprises a pair of hollow tubular vertical portions 111, 112 and a hollow tubular carrier 12. The tubular portions 111, 112 are angled downwardly toward each other with their lower extremities aligned in a uniformly spaced parallel relationship in their hollow tubular condition. The tubular carrier 12 is disposed between and intergrated with these tubular extremities of the tubular portions 111, 112. There are a plurality of orifices 121 opened and aligned axially on the wall of the tubular carrier 12 at selected intervals. A foot member 2 is telescoped within the tubular carrier 12. As with the above-mentioned conventional type, the foot member 2 has a radially outwardly spring biased detent 20 which can engage with any orifices 121 opened on the wall of the tubular carrier 12 and lock the foot member 2 in any disposition relative to the tubular carrier 12. The disposition of the foot member 2 relative to the tubular carrier 12 may be changed by pressing the detent 20 radially inwardly to where the foot member 2 may then be moved upwardly or downwardly in relation to the tubular carrier 12 for redisposition and locking by the detent 20.

As shown in FIG. 3, an arm member 113 is annexed to the top ends of the tubular portions 111, 112 and a hand member 114 is annexed between the spaced-apart paralleled portions of the tubular portions 111, 112. The disposition of the hand member 114 can be changed in several positions in response to the requirements of the users.

In this embodiment, the foot member 2 is relatively longer than the foot member E of the above-mentioned conventional type and can extend beyond the top end of the tubular carrier, so that as the crutch is adjusted in a relatively higher condition, the top end of the foot member 2 is near to the top end of the tubular carrier 12 and the stress generated by the foot member 2 will not center on the lower portion of the tubular carrier 12, tubular portions 111, 112 or the portions therebetween.

The most important merit to this is that the tubular carrier 12 is intergrated with the lower extremities of the tubular portions 111, 112, so the joining strength of the structure therebetween is not only dependent on the bolt and pins as in the above-mentioned conventional type. For this reason, the present invention will be strong and durable.

Figure 6:
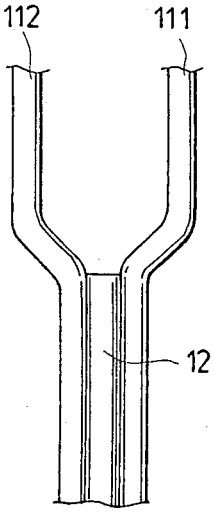
Figure 7:
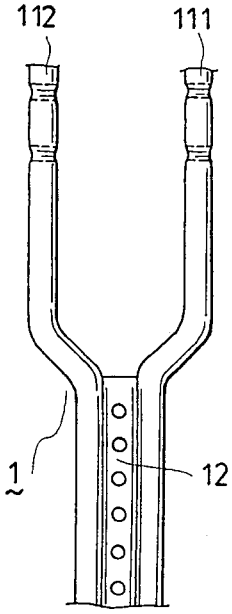

Concerning the manufacturing process re: the one-piece member 1, it is illustrated step by step as shown as in FIG. 4 to FIG. 7. At first, an intergrated tripple tube is extruded, as shown as in FIG. 4. Then, the upper portions of the tubes in the two sides of the tripple tube are cut away and angled upwardly to form a spaced-apart paralleled relationship with the mid tube, as shown as in FIG. 5. Then the upper portion of the mid tube is cut away. As shown in FIG. 6, the tubes in the two sides can now be used as tubular portions 111, 112 and the mid tube can be used as the tubular carrier 12. Then orifice the tubular carrier 12 and provide them with required treatments, so the one piece member 1 will be manufactured, as shown as in FIG. 7.

As in the above-mentioned embodiment, the structure of the height adjustable crutch, according to the present invention, is simpler and stronger than the conventional types that we can find today.

While the invention has been described in connection with what is presently considered to be the most practical and preferred embodiment, it is to be understood that the invention is not to be limited to the disclosed embodiment, but, on the contrary, is intended to cover various modifications and equivalent arrangements included within the spirit and scope of the broadest interpretation so as to encompass all such modifications and equivalent arrangements.

What is claimed is:

1. A walking aid readily adjustable for use by individuals of varying sizes, comprising:

(a) an extruded one piece integral leg support member, (b) at least three spaced aligned sections integrally formed in said leg support member, (c) said at least three spaced aligned sections including a pair of outer sections and a central section, (d) said outer sections having upper and lower portions, (e) said lower portions of said outer sections having upper and lower ends, (f) said lower portions of said outer sections extending substantially parallel to said central section, (g) said upper portions of said outer sections including upper and lower segments, (h) said lower segments of said upper portions of said outer sections extending upwardly from and forming an angle with said central section, (i) said upper segments of said upper portions of said outer sections extending upwardly from said lower segments and substantially parallel to said central section, (j) said central section including upper and lower ends and a hollow passageway extending between said upper and lower ends, (k) said upper end of said central section and said upper ends of said lower portions of said outer sections being positioned in a substantially common horizontal plane, (l) said lower ends of said central section and said lower ends of said lower portions of said outer sections being positioned in a substantially common horizontal plane, (m) said lower portions of said outer sections being joined to and extending along substantially the entire length of said central section such that said lower portions of said outer sections and said central section form a substantially solid piece, (n) a leg slidably positioned in said hollow passageway of said central section, and (o) means operably associated with said central section for adjustably securing said leg thereto.

2. A walking aid as in claim 1, wherein:

said central section has a substantially circular cross-section.

3. A walking aid as in claim 2, wherein:

said outer sections have a substantially circular cross-section.

4. A walking aid as in claim 1, wherein:

(a) said upper portions of said outer sections include upper and lower ends, and (b) an arm crutch support means extends between and is secured at opposing ends to said upper segments of said upper portions of said outer sections adjacent said upper ends of said upper portions.

5. A walking aid as in claim 4, wherein:

a hand grip means extends between and is secured at opposing ends to said upper segments of said upper portions of said outer sections adjacent said lower ends of said upper portions of said outer sections.

6. A walking aid as in claim 5, wherein:

said arm crutch support means extends substantially parallel to said hand grip means.

7. A walking aid as in claim 1, wherein:

said upper portions of said outer sections are greater in length than said lower portions of said outer sections.

8. A walking aid as in claim 1, wherein:

(a) said central section includes front and rear sides;

(b) said front and rear sides have a plurality of holes formed therein; and (c) said plurality of holes are spaced along the longitudinal axis of said central section.

9. A walking aid as in claim 1, wherein:

said adjustable securing means includes a spring biased detent having first and second transversely extending projections for engaging said holes formed in said front and rear sides of said central section.

10. A walking aid as in claim 1, wherein:

said upper and lower ends of said central section are open and free from obstruction for permitting said leg to pass therethrough.

11. A walking aid as in claim 1, wherein:

(a) said leg includes a substantially cylindrical shaped rod; and (b) said rod has a length substantially greater than said central section.

* * * * *